US005156718A

United States Patent [19]

Neubert

[11] Patent Number: 5,156,718

[45] Date of Patent: Oct. 20, 1992

[54] PAPER MATS

[75] Inventor: Terry C. Neubert, Kent, Ohio

[73] Assignee: GenCorp Inc., Fairlawn, Ohio

[21] Appl. No.: 643,391

[22] Filed: Jan. 18, 1991

Related U.S. Application Data

[63] Continuation of Ser. No. 435,139, Nov. 3, 1989, abandoned.

[51] Int. Cl.[5] ..... D21H 13/14

[52] U.S. Cl. ..... 162/145; 162/146; 162/158; 162/160; 162/168.1; 162/168.2; 162/168.3; 162/168.4; 162/168.6; 162/168.7; 162/169; 162/181.6; 162/181.8

[58] Field of Search ..... 162/145, 146, 168.1, 162/168.2, 168.3, 158, 169, 160, 168.4, 168.6, 168.7, 181.6, 181.8

[56] References Cited

U.S. PATENT DOCUMENTS

| | | | |
|---|---|---|---|
| 3,766,002 | 10/1973 | Greif et al. | 162/168.1 |
| 4,225,383 | 9/1980 | McReynolds | 162/145 |
| 4,487,657 | 12/1984 | Gomez | 162/168.1 |
| 4,545,854 | 10/1985 | Gomez et al. | 162/169 |

FOREIGN PATENT DOCUMENTS

| | | | |
|---|---|---|---|
| 0006903 | 1/1979 | Japan | 162/169 |

*Primary Examiner*—Peter Chin

[57] ABSTRACT

A paper mat is made from an aqueous slurry or dispersion of kraft wood pulp, a large amount of finely divided inorganic pigments and as a binder an anionic latex of a copolymer of at least one conjugated diene monomer, at least one vinyl substituted aromatic monomer, at least one acrylic-type monomer and at least one monomer having a vinyl group and an activatable methyl, ethyl, propyl or butyl ester group. The mat of this invention exhibits improved properties over mats made from other latex binders.

4 Claims, No Drawings

PAPER MATS

This application is a continuation of application Ser. No. 07/435,139, filed Nov. 3, 1989 for PAPER MATS, now abandoned.

BACKGROUND

Paper mats are formed from an aqueous slurry of kraft wood pulp, a predominant amount of finely divided inorganic pigments, a latex binder and other ingredients such as antioxidants, biocides and flocculents. The slurry is cast onto a fourdrinier machine from a head box where the water is largely removed, roll pressed to form a sheet which is then passed over drying cans, cooling cans, calendered and wound on a reel. See *Encyclopedia of Polymer Science and Technology*, Interscience Publishers, 1968, Vol. 9, pages 718 to 747. Kraft paper pulp may be made from wood chips boiled in an alkaline solution containing sodium sulfate.

To form a flooring tile, the mat is unwound from the reel, passed to a conveyor where the top layer of the mat is coated with a vinyl plastisol which is fluxed and cooled to form a vinyl coating which is then printed to form a design on the vinyl coating of the mat sheet. The design is then overcoated with a hot melt vinyl coating composition and cooled to form an abrasion-resistant top coating. The back side or opposite side of the mat sheet or layer is provided with a peelable foil of paper or plastic sheet. The resulting composite is then cut into appropriate sizes for use as flooring tiles. They are then assembled and placed in boxes for shipping.

An object of this invention is to provide an improved process for making a paper mat.

This and other objects of the present invention will become more apparent from the following description and example.

SUMMARY OF THE INVENTION

According to the present invention, a process for making an improved paper mat is provided wherein the latex binder used in the paper making process comprises an anionic emulsion of a copolymer of at least one conjugated diene monomer, at least one vinyl substituted aromatic monomer, at least one acrylic-type monomer and at least one monomer having a vinyl group and an activatable methyl, ethyl, propyl or butyl ester group.

DISCUSSION OF DETAILS AND PREFERRED EMBODIMENTS

The conjugated diene monomers have from 4 to 6 carbon atoms. Butadiene-1,3 is preferred. Examples of other diene monomers include isoprene, piperylene, 2,3-dimethyl-1,3-butadiene, pentadiene, hexadiene and the like. Mixtures of the dienes can be used.

The vinyl substituted aromatic monomers utilized in forming the latex copolymer have from 8 to 10 carbon atoms. Examples of such monomers include alpha methyl styrene, para methyl styrene, methyl vinyl toluene, p-vinyl toluene, 3-ethyl styrene and the like with styrene being preferred. In lieu of a single vinyl substituted aromatic type monomer, a plurality of such monomers can be utilized.

The acrylic-type monomer used has from 3 to 6 carbon atoms. Examples are acrylamide, methacrylamide, acrylic acid, methacrylic acid and itaconic acid. Mixtures of these acrylic type monomers can be used.

The monomer having a vinyl group and an activatable methyl, ethyl, propyl or butyl ester group is at least one monomer selected from the group consisting of methyl acrylamidoglycolate, ethyl acrylamidoglycolate, butyl acrylamidoglycolate, methyl acrylamidoglycolate methyl ether, butyl acrylamidoglycolate butyl ether, methyl methacryloxyacetate, ethyl acrylamido-N-oxalate (N-ethyloxalyl acrylamide), N,N'-Bis(ethyloxalyl)acrylamide, N-isopropyl, N-ethyloxalyl-3-propylamino methacrylamide, N-ethyloxalyl-N'-methyleneaminoacrylamide, ethyl N-2-ethyloxamatoacrylate, ethyl 3-pyruvylacrylate, ethyl methylenepyruvate, methyl acrylthiocarbonyloxyacetate (Methyl thiacryloxyacetate), methyl thiacrylthiogylcolate, methyl acryl-2-thioglycolate, methyl thiacrylamidoacetate, methyl acrylamidoglycolate thioether, methyl acrylamido-N-methylenethioglycolate and p-ethyl oxalyl styrene.

In the anionic latex disclosed herein the copolymer contains the diene monomer in an amount by weight of from about 30 to 60%, the vinyl substituted aromatic monomer in an amount by weight of from 36 to 66% by weight, the acrylic type monomer in an amount of from 1 to 4% by weight and the monomer having a vinyl group and an activatable methyl, ethyl, propyl or butyl ester group in an amount of from 3 to 6% by weight.

All percentages of monomers add up to 100%.

The copolymer employed in this invention is made in an aqueous alkaline medium containing an anionic surfactant or emulsifier such as an alkyl sulfate, an alkyl sulfosuccinate and the like. Free radical initiators are used such as the persulfates and peroxides and the like. Chain transfer agents like alkyl mercaptans are used. Other materials employed in the copolymerization process are shortstops, chelating agents, antioxidants, biocides and the like. Polymerization is continued to above 60% conversion and preferably above 90% conversion of monomers to copolymer and to provide a latex with a total solids content of from about 40 to 60% by weight. For methods of making latices, please see U.S. Pat. Nos. 4,788,008 and 4,808,660.

On a dry weight basis the aqueous slurry to form the mat comprises from about parts by weight:

Kraft wood pulp 5. to 20.
Polyethylene particles 0.5 to 3.0 to improve pulping
Finely divided clay 60. to 85. or talc (clay preferred)
Glass ribers, chopped 1. to 2.
Antioxidant 0.05 to 0.25
Water clarifier 0.01 to 0.02
Latex copolymer 8. to 16.
Flocculants, surfactants and defoamers, also, may be added to the slurry.

The following examples will serve to illustrate the present invention with more particularity to those skilled in the art.

EXAMPLES

Aqueous slurries were prepared from, on a dry parts-by-weight basis:

| | |
|---|---|
| Kraft wood pulp | 13.0 |
| Pulpex P, Grade A-DC polyethylene particles | 1.00 |
| NARVON F-3 clay | 15.70 |
| Afton clay | 36.60 |
| Dicalite (not clay) | 18.00 |
| Glass fibers | 1.50 |
| Antioxidant | 0.1 |

-continued

| | |
|---|---|
| Water clarifier, KYMENE | 0.0125 |
| Latex copolymer (various) | 14.0 |

The slurries were flocculated with catiomic flocculation cast onto wire screens to remove the water to form sheets which were compressed, heated and cooled to form mats which were then tested.

The anionic latices used were the following copolymers (parts by weight of monomers):

A. Copolymer of 40 butadiene, 51.5 styrene, 1.5 itaconic acid, 2 acrylamide and 5 methyl acrylamidoglycolate methyl ether

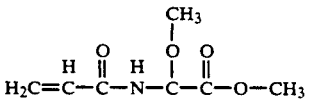

B. Copolymer of 42 butadiene-1,3, 54 styrene, 0.5 itaconic acid, 3 acrylamide and 0.5 methacrylic acid.

C. Copolymer of 45 butadiene, 51 styrene, 0.5 itaconic acid, 3 acrylamide and 0.5 methacrylic acid.

D. Copolymer of 51 butadiene and 49 styrene.

E. Copolymer of 48.75 butadiene-1,3, 44.25 styrene, 1.5 itaconic acid, 2.5 acrylamide, 2.5 N-methylolacrylamide and 0.5 divinylbenzene.

F. Same as E but from a larger batch of latex.

G. Blend of 30% of a copolymer of 30 butadiene-1,3, 65.25 styrene, 0.75 methacrylic acid, 1.75 hydroxyethylacrylate and 2.25 itaconic acid and 70% of a copolymer of 45 butadiene-1,3, 51 styrene, 0.5 itaconic acid, 3 acrylamide and 0.5 methacrylic acid.

H. Commercial latex.

I. Same as copolymer B.

MAT PROPERTIES

| RUN SHEET NO. | COLD TENSILE LBS. | COLD TENSILE ELON. % | COLD PLASTICIZER TENSILE | SPLIT STRENGTH LBS MIN. | MAX. | MEAN | POCKET HEAT AGE SEC | % PLASTICIZER PU |
|---|---|---|---|---|---|---|---|---|
| A | — | — | — | 0.20 | 0.35 | 0.26 | — | 42.1 |
| | 24.84 | 2.57 | — | — | — | — | 114 | |
| | — | — | 15.52 | — | — | — | — | |
| B | — | — | — | 0.13 | 0.41 | 0.22 | | 43.9 |
| | — | — | 11.88 | — | — | — | — | |
| | 20.69 | 3.16 | — | — | — | — | 105 | |
| C | — | — | — | 0.17 | 0.32 | 0.23 | — | 44.2 |
| | 23.24 | 2.70 | — | — | — | — | 111 | |
| | — | — | 13.73 | — | — | — | — | |
| D | — | — | — | 0.11 | 0.19 | 0.14 | — | 41.6 |
| | — | — | 8.80 | — | — | — | — | |
| | 17.72 | 3.14 | — | — | — | — | 66 | |
| E | — | — | — | 0.16 | 0.26 | 0.20 | — | 46.8 |
| | 21.63 | 2.77 | — | — | — | — | 126 | |
| | — | — | 13.09 | — | — | — | — | |
| F | — | — | 12.30 | — | — | — | — | 44.8 |
| | — | — | — | 0.22 | 0.35 | 0.27 | — | |
| | 21.93 | 2.77 | — | — | — | — | 135 | |
| G | — | — | — | 0.23 | 0.36 | 0.28 | — | 43.3 |
| | — | — | 13.74 | — | — | — | — | |
| | 27.13 | 3.65 | — | — | — | — | 171 | |
| H | — | — | 13.10 | — | — | — | — | 45.3 |
| | — | — | — | 0.17 | 0.27 | 0.22 | — | |
| | 25.49 | 3.59 | — | — | — | — | 72 | |
| I | 25.57 | 3.05 | — | — | — | — | 105 | 46.6 |
| | — | — | 11.84 | — | — | — | — | |
| | — | — | — | 0.18 | 0.32 | 0.23 | — | |

| RUN SHEET NO. | DRAIN TIME SEC. | SHEET THICKNESS WT. | MILS | DENSITY LBS/FT$^3$ | HOT TENSILE LBS. | HOT TENSILE ELON. % | HOT PLASTICIZER TENSILE |
|---|---|---|---|---|---|---|---|
| A | 2.22 | 22.04 | 25.50 | 52.4 | — | — | — |
| | 2.34 | 23.62 | 27.00 | 51.9 | 16.79 | 2.03 | |
| | 2.22 | 22.86 | 25.72 | 52.8 | — | — | 10.36 |
| B | 1.69 | 23.90 | 28.11 | 50.5 | — | — | — |
| | 1.53 | 23.44 | 26.33 | 52.9 | — | — | 7.12 |
| | 1.64 | 23.81 | 26.61 | 53.1 | 9.88 | 1.42 | — |
| C | 1.95 | 22.74 | 25.67 | 52.6 | — | — | — |
| | 1.97 | 23.22 | 26.89 | 51.3 | 15.26 | 2.00 | — |
| | 1.97 | 23.41 | 26.17 | 53.1 | — | — | 7.85 |
| D | 1.50 | 22.46 | 25.00 | 53.3 | — | — | — |
| | 1.55 | 22.55 | 26.22 | 51.1 | — | — | 4.76 |
| | 1.44 | 21.89 | 25.22 | 51.5 | 7.79 | 0.84 | — |
| E | 1.69 | 22.04 | 25.67 | 51.0 | — | — | — |
| | 1.61 | 22.48 | 25.94 | 51.5 | 16.03 | 2.20 | — |
| | 1.77 | 22.83 | 26.33 | 51.5 | — | — | 9.40 |
| F | 1.50 | 22.39 | 25.67 | 51.8 | — | — | 8.83 |
| | 1.45 | 23.05 | 27.17 | 50.4 | — | — | — |
| | 1.42 | 22.47 | 26.61 | 50.1 | 13.87 | 1.88 | — |
| G | 2.28 | 20.93 | 23.72 | 52.4 | — | — | — |
| | 2.34 | 20.64 | 24.28 | 50.5 | — | — | 8.58 |

-continued

| MAT PROPERTIES | | | | | | | |
|---|---|---|---|---|---|---|---|
| | 2.29 | 20.99 | 23.94 | 52.1 | 15.04 | 2.41 | — |
| H | 1.80 | 21.37 | 25.22 | 50.3 | — | — | 8.99 |
| | 1.73 | 20.98 | 23.44 | 53.1 | — | — | — |
| | 1.78 | 21.13 | 24.28 | 51.7 | 15.69 | 2.16 | — |
| I | 2.14 | 21.22 | 24.83 | 50.7 | 14.67 | 2.09 | — |
| | 2.01 | 22.11 | 26.06 | 50.4 | — | — | 7.72 |
| | 2.06 | 21.36 | 24.33 | 52.1 | — | — | — |

The results show that mats made from copolymer A gave better results than mats from copolymer B and I (the controls). Further runs of mats made from copolymer A exhibited improvement in ambient tensile, hot tensile, ambient plasticizer tensile, hot plasticizer tensile and split strength over mats made from other copolymers.

What is claimed is:

1. The method which comprises forming an aqueous slurry to make a mat comprising on a dry weight basis from about, in parts by weight:

| | |
|---|---|
| 5.0 to 20.0 | kraft wood pulp |
| 0.5 to 3.0 | polyethylene particles |
| 60.0 to 85.0 | finely divided clay or talc |
| 1.0 to 2.0 | chopped glass fibers |
| 0.1 to 0.0015 | antioxidant |
| 0.01 to 0.02 | water clarifier, and |
| 8.0 to 16.0 | copolymer binder (from an anionic latex) |

forming a sheet on a screen from the slurry, removing water from the slurry using the screen to form a sheet, compressing the sheet and drying and cooling the sheet to form a paper mat wherein the latex of the copolymer binder has a solids content of from about 40 to 60% and wherein the copolymers of the latex comprises:

(a) from about 30 to about 60% by weight of at least one conjugated diene monomer selected from the group consisting of butadiene-1,3, isoprene, piperylene, 2,3-dimethyl-1,3-butadiene, pentadiene and hexadiene.

(b) from about 36 to 66% by weight of at least one vinyl substituted aromatic monomer selected from the group consisting of styrene, alpha methyl styrene, para methyl styrene, methyl vinyl toluene, p-vinyl toluene and 3-ethylstyrene.

(c) from about 1 to 4% by weight of at least one acrylic type monomer selected from the group consisting of acrylamide, methacrylamide, itaconic acid, acrylic acid and methacrylic acid.

(d) from about 3 to 6% by weight of at least one monomer having a vinyl group and an activatable methyl, ethyl, propyl or butyl ester group, and selected from the group consisting of methyl acrylamidoglycolate, ethyl acrylamidoglycolate, butyl acrylamidoglycolate, methyl acrylamidoglycolate methyl ether, butyl acrylamidoglycolate butyl ether, methyl methacrylaoxyacetate, ethyl acrylamido-N-oxalate (N-ethyloxalyl acrylamide), N, N'-Bis (ethyloxalyl) acrylamide, N-isopropyl, N-ethyloxalyl-3-propylamino methacrylamide, N-ethyloxalyl-N'-methyleneaminoacrylamide, ethyl N-2-ethyloxamatoacrylate, ethyl 3-pyruvylacrylate, ethyl methylenepyruvate, methyl acrylthiocarbonyl-oxyacetate (methyl thiacryloxyacetate), methyl thiacrylthioglylcolate, methyl acryl-2-thioglycolate, methyl acryl-2-thioglycolate, methyl thiacrylamidoacetate, methyl acrylamidoglycolate thioether, methyl acrylamido-N-methylenethioglycolate and p-ethyl oxalyl styrene.

2. The method according to claim 2, wherein said conjugated diene monomer is butadiene-1,3-where said vinyl substituted aromatic monomer is styrene, where said acrylic-type monomer is a mixture of itaconic acid and acrylamide and where the monomer having a vinyl group and an activatable vinyl, ethyl, propyl or butyl ester group is methylacrylamidoglycolate methyl ether.

3. The product produced by the method of claim 2.

4. A paper mat comprising about, in a dry weight basis, in parts by weight:

| | |
|---|---|
| 5.0 to 20.0 | kraft wood pulp |
| 0.5 to 3.0 | polyethylene particles |
| 60.0 to 85.0 | finely divided clay or talc |
| 1.0 to 2.0 | chopped glass fibers |
| 0.0 to 0.0015 | antioxidant |
| 0.01 to 0.02 | water clarifier, and |
| 8.0 to 16.0 | copolymer binder from an anionic latex having a solids content of from about 40 to 60% by weight |

wherein the copolymer comprises (a) from about 30 to 60% by weight of at least one conjugated diene selected from group consisting of butadiene-1,3, isoprene, piperylene, 2,3-dimethyl-1,3-butadiene, pentadiene and hexadiene, (b) from about 36 to 66% by weight of at least one vinyl substituted aromatic monomer selected from the group consisting of styrene, alpha methyl styrene, para methyl styrene, methyl vinyl toluene, p-vinyl toluene and 3-ethyl stryene, (c) from about 1 to 4% by weight of at least one acrylic type monomer selected from the group consisting of acrylamide, methylacrylamide, itaconic acid, acrylic acid and methacrylic acid, (d) from about 3 to 6% by weight of at least one monomer having a vinyl group and an activatable methyl, ethyl, propyl or butyl group and selected from the group consisting of:

methyl acrylamidoglycolate
ethyl acrylamidoglycolate
butyl acrylamidoglycolate
methyl acrylamidoglycolate methyl ether
butyl acrylamidoglycolate butyl ether
methyl methacrylaxyacetate
ethyl acrylamido-N-oxalate (N-ethyloxalyl acrylamide)
N-N'-Bis(ethyloxalyl)acrylamide
ethyl N-2-ethyloxamatoacrylate
ethyl 3-pyruvylacrylate
methyl acrylthiocarbonyloxyacetate (Methyl thiacryloxyacetate)
methyl thiacrylthiogylcolate
methyl acryl-2-thioglycolate
methyl thiacrylamidoacetate
methyl acrylamidoglycolate thioether
methyl acrylamido-N-methylenethioglycolate, and
p-ethyl oxalyl styrene.

* * * * *